United States Patent [19]

Takimoto

[11] 4,382,318

[45] May 10, 1983

[54] BUCKLES

[75] Inventor: Yoshimi Takimoto, Tokyo, Japan

[73] Assignee: Yoshimi Mfg., Co., Ltd., Tokyo, Japan

[21] Appl. No.: 218,812

[22] Filed: Dec. 22, 1980

[30] Foreign Application Priority Data

May 13, 1980 [JP] Japan ..... 55-65258[U]
Jul. 31, 1980 [JP] Japan ..... 55-108620[U]

[51] Int. Cl.[3] ..... A44B 11/25

[52] U.S. Cl. ..... 24/188; 24/71 J; 24/206 B; 24/265 WS

[58] Field of Search ..... 24/206 R, 206 B, 241 P, 24/241 SP, 265 R, 265 WS, 71 J, 188, 265 BC

[56] References Cited

U.S. PATENT DOCUMENTS

| | | | |
|---|---|---|---|
| 1,814,475 | 7/1931 | Kesterman | 24/206 B |
| 3,113,362 | 12/1963 | Petruzziello | 24/206 B |
| 3,404,440 | 10/1968 | Weiss | 24/265 WS |
| 3,478,537 | 11/1969 | Golberine et al. | 24/265 WS |
| 3,574,903 | 4/1971 | Namiki | 24/265 WS |
| 3,711,906 | 1/1973 | Leon | 24/265 WS |
| 3,900,934 | 8/1975 | Luft et al. | 24/265 WS |
| 4,158,904 | 6/1979 | Learn | 24/265 WS |
| 4,332,061 | 6/1982 | Rieth et al. | 24/265 WS |

FOREIGN PATENT DOCUMENTS

| | | | |
|---|---|---|---|
| 1113621 | 4/1956 | France | 24/206 B |
| 724815 | 11/1966 | Italy | 24/265 WS |
| 416191 | 1/1967 | Switzerland | 24/206 B |

*Primary Examiner*—Paul J. Hirsch
*Attorney, Agent, or Firm*—Darby & Darby

[57] ABSTRACT

A buckle is used for connecting the opposite ends of a strap together, one of the ends having a plurality of longitudinally spaced apertures. The buckle comprises a base member, and a cover member lockingly engageable with the base member to cover the same. The cover member is adapted to be attached to the other end of the strap. A lock tongue is provided on the base member for being selectively inserted into one of the apertures to retain the one end of the strap against movement.

4 Claims, 6 Drawing Figures

BUCKLES

BACKGROUND OF THE INVENTION

1. Field of the Invention

This invention relates to buckles for straps, for example, straps such as are employed for securing a wrist watch to the wrist of the wearer.

A typical example of conventional wrist watches comprises a watch strap consisting of first and second strap lengths attached to the watch at their one ends, and a buckle attached to the first strap length at the other end, the second strap length having a plurality of apertures spaced along the length thereof. The buckle is usually in the form of a square or rectangular loop and has a tongue pivotally mounted on its inner end portion and adapted to be selectively inserted into one of the apertures of the second strap length. For securing the wrist watch to the wrist of the wearer, the second strap length having the apertures is threaded through the buckle and is longitudinally folded back around the outer end portion of the buckle to adjust the effective length of the watch strap. Then, the tongue in inserted into one of the apertures to connect the two strap lengths together. The first strap length has a loop fitted thereon and positioned adjacent to the buckle for receiving the free end portion of the second strap length extending outwardly of the buckle to hold the same flat against the first strap length. Thus, the second strap length is folded back each time the two strap lengths are connected together and disconnected. As a result, the second strap length is susceptible to deformation and abrasion. This problem is serious particularly when the watch strap is made of expensive material such as high quality leather which cannot be replaced by a new one at low costs. Another disadvantage of the conventional buckle is that the buckle tongue inserted into one of the apertures of the second strap length falls to positively retain the second strap length against longitudinal movement toward the first strap length. Further, the free end portion of the second strap length extending outwardly of the buckle and threaded through the loop detracts from the appearance of the watch strap.

SUMMARY OF THE INVENTION

It is therefore an object of this invention to provide a buckle of the type which eliminates the abovementioned deficiencies of the prior art.

According to the invention, there is provided a buckle for connecting the opposite ends of a strap together, one of the ends having a plurality of longitudinally spaced apertures, said buckle comprising a base member; a cover member lockingly engageable with said base member to cover the same, said cover member being adapted to be attached to the other end of the strap; and a lock tongue on said base member adapted to be selectively inserted into one of the apertures for retaining the one end of the strap against movement.

Other advantages, features and additional objects of the present invention will become manifest to those versed in the art upon making reference to the detailed description and the accompanying sheets of drawings in which preferred embodiments incorporating the principles of the present invention are shown by way of illustrative examples.

DESCRIPTION OF THE PREFERRED EMBODIMEMTS

Figure 1:
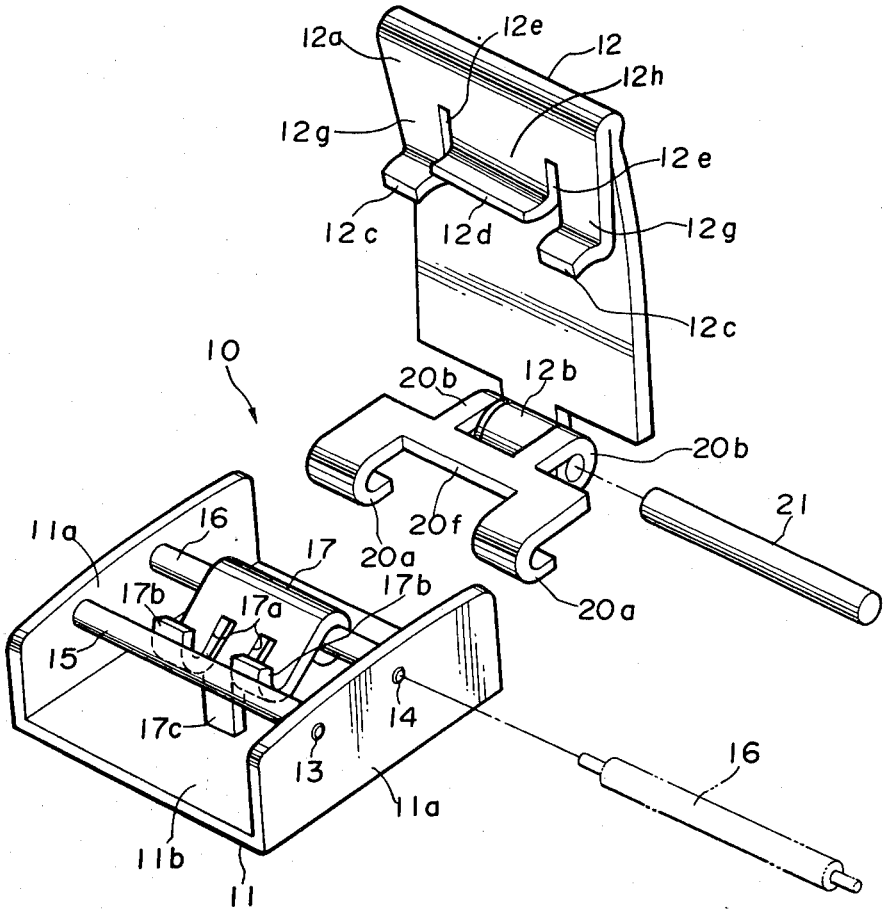
FIG. 1 is an exploded, perspective view of a buckle provided in accordance with the present invention.
Figure 2:
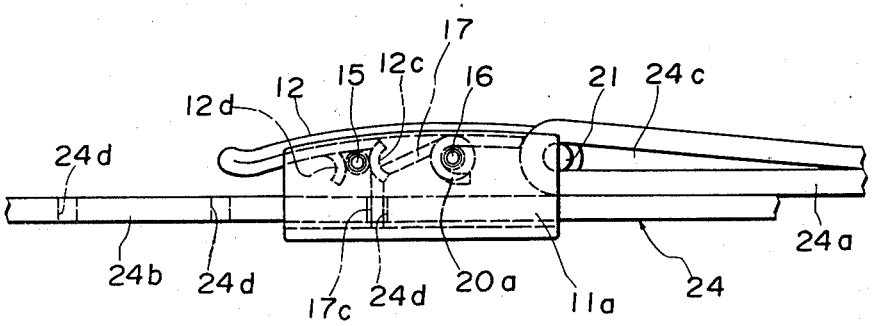
FIG. 2 is a side view of the buckle as shown attached to a strap.

FIG. 1 shows a fastening device or buckle 10 which comprises a base member 11 and a cover member 12. The base member includes a body of a channel-shaped cross-section defined by a pair of parallel spaced arms 11*a*, 11*a* and a base or bottom portion 11*b* interconnecting the arms at their one ends. The base member 11 is made of metal or a rigid synthetic resin. A pair of aligned apertures 13 are formed through the arms 11*a*, 11*b*, respectively, adjacent the upper edges thereof. Also, another pair of aligned apertures 14 are formed through the arms 11*a*, 11*a*, respectively adjacent to the upper edges thereof. A retaining pin 15 has opposite ends of a smaller diameter fitted into the pair of aligned apertures 13 so that the pin 15 is rotatably mounted on the base member 11. Similarly, a mounting pin 16 has opposite ends of a smaller diameter fitted into the pair of aligned apertures 14 so that the pin 16 is rotatably mounted on the base member 11. The opposite ends of each of the pins 15, 16 are spring-biased so as to be axially retractable. This enables the pins 15, 16 to be detachably mounted on the base member 11. The pins 15, 16 are disposed in parallel spaced relation to the bottom portion 11*b* and spaced in the direction of the length of a strap 24 (FIG. 2).

A lock element 17 is made of a metal plate and is wound around the mounting pin 16 at one end. Thus, the lock element 17 is fixedly mounted centrally on the pin 16 for pivotal movement thereabout. The major portion of the lock element 17 is divided by a pair of slots 17*a*, 17*a* into three sections, and the opposite side sections and the intermediate section therebetween are bent at their end portions in opposite directions to provide a pair of retaining tongues 17*b*, 17*b* and a lock tongue 17*c*, respectively, as shown in FIG. 1. The lock element 17 is pivotally movable about the mounting pin 16 in a counterclockwise direction (FIG. 1) into a locked position where the retaining tongues 17*b*, 17*b* are resiliently engaged with the retaining pin 15 to retain the lock element 17 against pivotal movement. When the lock element 17 is in its locked position as shown in FIG. 1, the lock tongue 17*c* is held against the bottom portion 11*b* at its end.

The cover member 12 comprises a metal plate of a generally rectangular shape. The cover member 12 is foled upon itself at one end portion to provide a folded portion 12*a*, the cover member having a tubular portion 12*b* of less width formed centrally at the other end. The folded portion 12*a* has a lock means for locking the cover member 12 relative to the base member 11, as will hereinafter be more fully described. The lock means comprises a pair of aligned side lugs 12*c*, 12*c* and an intermediate lug 12*d* lying therebetween and disposed out of registry with the side lugs 12*c*. The major portion of the folded portion 12*a* is divided by a pair of slots 12*e*, 12*e* into three leg sections 12*g*, 12*g* and 12*h* which are bent in a direction away from the front face of the cover member 12 to provide the side lugs 12*c*, 12*c* and the intermediate lug 12*d*. The side lugs 12*c*, 12*c* and the intermediate lug 12*d* are slightly bent in opposed directions to provide respective convex arcuate surfaces.

A connecting element 20 is made of a metal plate and has a pair of hook portions 20*a*, 20*a* and a pair of spaced ring portions 20*b*, 20*b*, the hook portions 20*a*, 20*a* being spaced by a notch 20*f* of a U-shaped contour lying therebetween. As shown in FIG. 1, the tubular portion 12*b* is adapted to be received between the ring portions 20*b*, 20*b* so that they are hingedly connected together by a pin 21 passing therethrough.

Figure 3:
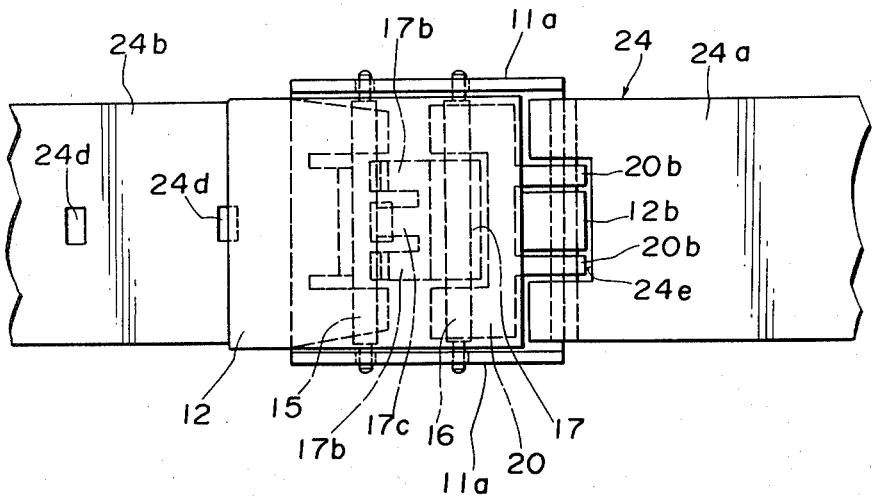
FIG. 3 is a plan view of the buckle attached to the strap.

As best shown in FIG. 2, a wrist strap 24 comprises two strap lengths 24*a*, 24*b* made of a flexible material such as leather. The first strap length 24*a* is folded longitudinally upon itself at one end to provide a loop 24*c*. The first strap length 24*a* has a cut-away portion or recess 24*e* formed centrally in the folded end thereof, as shown in FIG. 3. For connecting the cover member 12, the connecting member 20 and the first strap length 24*a* together, the tubular portion 12*b* is received between the pair of ring portions 20*b*, 20*b*, and these portions are received in the recess 24*e* in such a manner that the ring portions, the tubular portion and the loop 24*c* are disposed in alignment with one another. The pin 21 is passed through the thus aligned portions to hingedly connect the components 12, 20 and 24*a* together.

The second strap length 24*b* has a plurality of apertures 24*d* formed through one end portion and spaced along the length thereof, the apertures 24*d* being disposed centrally of the width of the strap length 24*b*. The first and second strap lengths 24*a*, 24*b* are attached at their one ends to a wrist watch (not shown). The width of the bottom portion 11*b* between the pair of arms 11*a*, 11*a* is slightly larger than the width of the strap length 24*b*.

For attaching the second strap length 24*b* to the base member 11, the lock element 17 is held out of the locked position. The second strap length 24*b* is threaded through the base member 11 with its reverse surface in sliding contact with the bottom portion 11*b*, so that the length of the strap length 24*b* between the watch (not shown) and the base member 11 is adjusted to permit the watch strap 24 to fit around the wrist of the wearer. In this condition, one of the apertures 24*d* is disposed within the base member 11 in such a position that the lock tongue 17*c* is engageable with the aperture 24*d* when the lock element 17 is moved into the locked position. Then, the lock element 17 is pivotally moved about the mounting pin 16 into the locked position so that the lock tongue 17*c* is received in the aperture 24*d* to lock the strap length 24*b* against longitudinal movement. In this condition, the pair of retaining tongues 17*b*, 17*b* are resiliently engaged with the retaining pin 15 to retain the lock element 17 against pivotal movement. The strap length 24*b* is prevented by the pair of arms 11*a*, 11*a* from lateral movement.

For connecting the base member 11 and the cover member 12 together to permit the watch strap 24 to be fitted around the wrist of the wearer, the pair of hook portions 20*a*, 20*a* are engaged with the mounting pin 16, with the end portion of the lock element 17 wound around the pin 16 being received in the notch 20*f*. Then, the cover member 12 is pivotally moved about the pin 21 toward the base member 11 so that the retaining pin 15 is snappingly received between the pair of side lugs 12*c*, 12*c* and the intermediate lug 12*d* to retain the cover member 12 against pivotal movement, as shown in FIGS. 2 and 3. In this condition, the side lugs 12*c*, 12*c* and the intermediate lug 12*d* are resiliently engaged with the retaining pin 15, and the leg sections 12*g*, 12*g* are held in contact with the pin 15. The cover member 12 is received between the pair of arms 11*a*, 11*a* with its front surface lying slightly outwardly of the arms 11*a*, 11*a* and with the end of the folded portion 12*a* extending longitudinally outwardly of the base member 11, as best shown in FIG. 2. The end portion of the strap length 24*b* is held against the folded end of the strap length 24*a*.

For disconnecting the cover member 12 from the base member 11, the cover member 12 is pivotally moved about the pin 21 toward the first strap length 24*a* to disengage the side lugs 12*c*, 12*c* and the intermediate lug 12*d* from the retaining pin 15. Then, the hook portions 20*a*, 20*a* are disengaged from the mounting pin 16 to disconnect the cover member 12 from the base member 11.

For releasing the locking of the strap length 24*b* relative to the base member 11, the lock element 17 is pivotally moved about the pin 14 out of the locked position so that the retaining tongues 17*b*, 17*b* are disengaged from the retaining pin 15, with the lock tongue 17*c* moved out of engagement with the aperture 24*b*. During this releasing operation, the retaining tongues 17*b*, 17*b* and the lock tongue 17*c* are elastically deformed by the retaining pin 15.

The retaining pin 15 is rotatably journalled in the apertures 13, 13 of the arms 11*a*, 11*a*, as described above. If either the side lugs 12*c*, 12*c* or the intermediate lug 12*d* engage the retaining pin 15 under a greater load, the retaining pin 15 is caused to rotate when these lugs 12*c*, 12*c* and 12*d* are fitted on and disengaged from the retaining pin 15.

Figure 4:
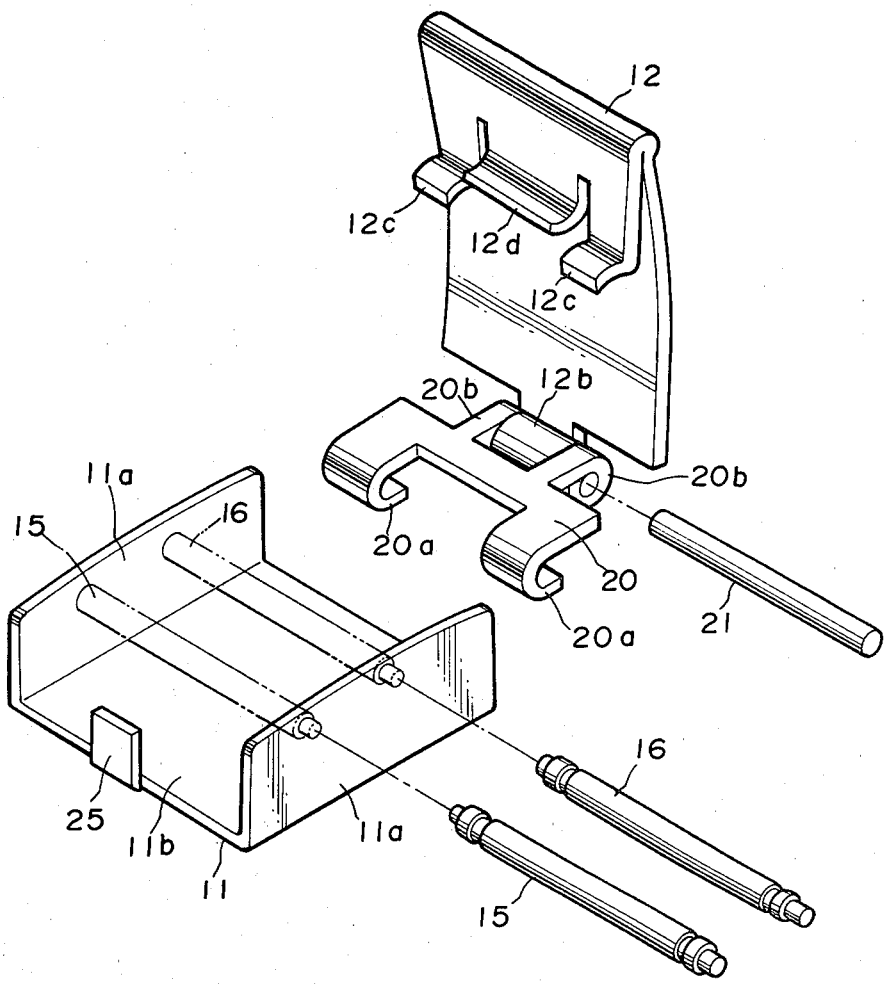
FIG. 4 is a view similar to FIG. 1 but showing a modified buckle.
Figure 5:
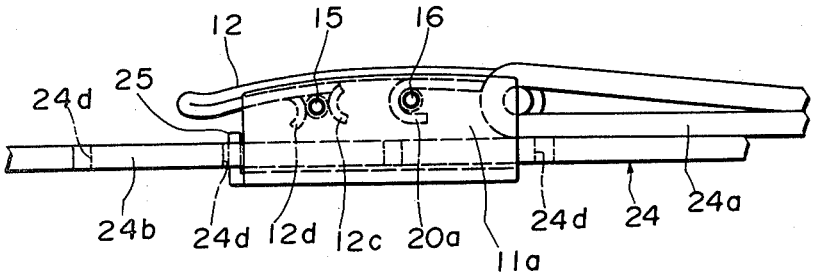
FIG. 5 is a view similar to FIG. 2 but showing the modified buckle.
Figure 6:
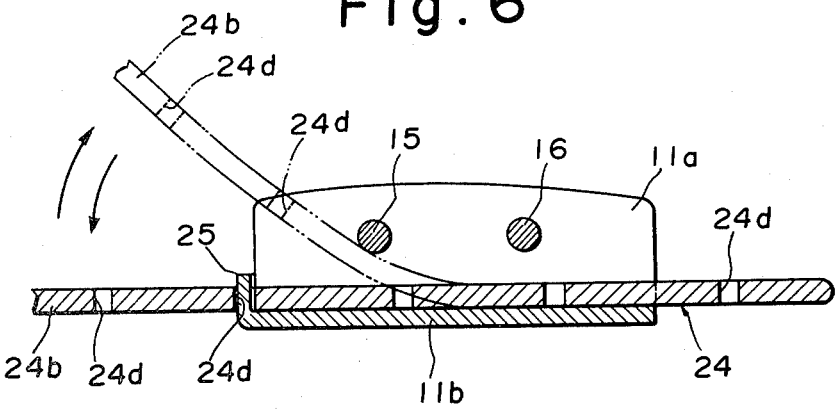
FIG. 6 is a longitudinal cross-sectional view of the modified buckle attached to the strap.

According to a modified form of the invention shown in FIGS. 4 to 6, the base member 11 has a lock tongue 25 formed integrally on one end of the bottom portion 11*b*. The lock tongue 25 extends perpendicular to the bottom portion 11*b* and is disposed centrally of the width of the bottom portion 11*b*. The lock tongue 25 and the pair of arms 11*a*, 11*a* extends in the same direction. For attaching the second strap length 24*b* to the base member 11, the end of the strap length 24*b* is first introduced between the retaining pin 15 and the lock tongue 25 and is threaded through the base member 1 with the strap length 24*b* spaced from the lock tongue 25, as shown in phantom in FIG. 6. Thus, the length of the strap length 24*b* between the watch (not shown) and the base member 11 is adjusted. Then, the strap length 24*b* is laid flat aganst the bottom portion 11*b* so that the lock tongue 25 is received in one of the apertures 24*d* to retain the strap length 24*b* against longitudinal movement. The connection between the base member 11 and the cover member 12 is carried out as described above. Thus, the provision of the integral lock tongue 25 obviates the need for the lock element 17.

By virtue of the provision of the buckle 10, the strap length 24*b* is not subjected to abrasion by the buckle, and therefore the watch strap can be used without damage for a prolonged period of time. Further, the free end of the strap length 24*b* is held flat against the rear surface of the strap length 24*a*. This is apparently aesthetically appealing. Further, the base member and the cover member can be easily connected together and disconnected.

What is claimed is:

1. A buckle for connecting the opposite ends of a strap together, one of the ends having a plurality of longitudinally spaced apertures, said buckle comprising:

(a) a base member;

(b) a cover member lockingly engageable with said base member to cover the same, said cover member being adapted to be attached to the other end of the strap; and (c) a lock tongue on said base member adapted to be selectively inserted into one of the apertures for retaining the one end of the strap against movement;

said cover member being engageable at one end with said base member for pivotal movement toward and away from said base member, said cover having at the other end a lock means lockingly engageable with said base member, said base member being of a channel-shaped cross-section defined by a pair of arms and a bottom portion interconnecting said arms at their one ends, said lock means comprising a pair of side lugs and an intermediate lug disposed therebetween out of registry with said side lugs, said base member having a retaining pin and a mounting pin journalled in said arms, said pins being spaced along the length of the strap, said side lugs and intermediate lug being lockingly engageable with said retaining pin, and said cover member being engageable at the one end with said mounting pin.

2. A buckle according to claim 1, further including a connecting member pivotally connected to the one end of said cover member and having a hook portion engageable with said mounting pin.

3. A buckle according to claim 1, in which said lock tongue is formed integrally on said base member.

4. A buckle according to claim 1, further including a lock element mounted on said mounting pin for pivotal movement, said lock element having said lock tongue and a retaining tongue lockingly engageable with said retaining pin to lock said lock element against pivotal movement.

* * * * *